US006782722B2

(12) United States Patent
Yokoi et al.

(10) Patent No.: US 6,782,722 B2
(45) Date of Patent: Aug. 31, 2004

(54) DRUM WASHING MACHINE

(75) Inventors: Yasuhiko Yokoi, Moriguchi (JP); Hiroshi Yamamoto, Moriguchi (JP); Yasuaki Sonoda, Moriguchi (JP); Takao Kinouchi, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/251,862

(22) Filed: Sep. 23, 2002

(65) Prior Publication Data

US 2003/0056555 A1 Mar. 27, 2003

(30) Foreign Application Priority Data

Sep. 25, 2001 (JP) ..... 2001-291715

(51) Int. Cl.[7] ..... D06F 37/22

(52) U.S. Cl. ..... 68/12.06; 68/23.1; 68/23.2; 68/23.4; 74/573 F

(58) Field of Search ..... 68/12.06, 23.1, 68/23.2, 23.4, 23.5; 74/573 F

(56) References Cited

U.S. PATENT DOCUMENTS

| | | | | |
|---|---|---|---|---|
| 2,647,386 | A | * | 8/1953 | Keiper |
| 2,760,383 | A | * | 8/1956 | Demoss |
| 2,886,979 | A | * | 5/1959 | Baxter |
| 3,214,946 | A | * | 11/1965 | Starr et al. |
| 3,235,082 | A | * | 2/1966 | Compans |
| 3,800,567 | A | * | 4/1974 | Stelwagen et al. |
| 4,295,387 | A | | 10/1981 | Zhivotov et al. |
| 5,345,792 | A | * | 9/1994 | Farrington et al. |
| 5,419,164 | A | * | 5/1995 | Durazzani |
| 5,458,979 | A | * | 10/1995 | Hashimoto et al. |
| 5,513,504 | A | * | 5/1996 | Sribar et al. |
| 5,582,040 | A | * | 12/1996 | Khan |
| 5,678,430 | A | * | 10/1997 | Merlin et al. |
| 5,746,069 | A | * | 5/1998 | Kim |
| 6,122,843 | A | | 9/2000 | Noguchi et al. |
| 6,418,758 | B1 | * | 7/2002 | Ikeda et al. |
| 6,510,715 | B1 | * | 1/2003 | Simsek |

FOREIGN PATENT DOCUMENTS

| | | | |
|---|---|---|---|
| DE | 2105507 | | 8/1972 |
| DE | 2113655 | | 9/1972 |
| DE | 4020554 | | 1/1992 |
| DE | 4020554 | * | 2/1992 |
| EP | 0607678 A1 | | 7/1994 |
| GB | 2080836 | * | 2/1982 |
| JP | 53-51671 | * | 5/1978 |
| JP | 04-150898 | | 5/1992 |
| JP | 04-240488 | | 8/1992 |
| JP | 2001-029682 | | 2/2001 |
| WO | WO 99/53130 | | 10/1999 |

OTHER PUBLICATIONS

European Patent Office 476,423 Mar. 1992.*
European Patent Office 487,311 May 1992.*

* cited by examiner

*Primary Examiner*—Frankie L. Stinson
(74) *Attorney, Agent, or Firm*—Rabin & Berdo, P.C.

(57) ABSTRACT

A drum washing machine according to the present invention restrains vibration and noise at the time of spin-drying. For this purpose, a drum 4 is supported so as to be rotatable by rotating shafts 51L and 51R respectively extending in an approximately horizontal direction outward from its end surface walls 41L and 41R. Water storage balancers G are respectively attached to the end surface walls 41L and 41R of the drum 4, and a fluid balancer 9 is further attached to the end surface wall 41L.

17 Claims, 8 Drawing Sheets

DRUM WASHING MACHINE

This application is based on an application No. 2001-291715 filed in Japan, the content of which is incorporated hereinto by reference.

BACKGROUND OF THE INVENTION

1. Field of the Invention

The present invention relates to a washing machine comprising a centrifugal spin-drying function, and particularly, to a drum washing machine having a drum that rotates around its approximately horizontal axis.

2. Description of Related Art

A drum washing machine comprises a cylindrical drum that rotates for washing and spin-drying with the washing put therein. The drum is provided with its end surfaces extending in a front-and-back direction inside a cylindrical outer tank. A rotating shaft extending in an approximately horizontal direction is connected to the rear end surface of the drum. The rotating shaft is received in the outer tank so as to be rotatable, to project toward the back of the outer tank. A motor is coupled to a rear end of the rotating shaft using a DD (Direct Drive) system, for example. The drum is rotated around the rotating shaft inside the outer tank by driving force of the motor.

One of problems of the drum washing machine is that when the drum is rotated at high speed with the washing unevenly distributed inside the drum at the time of spin-drying, an eccentric load is produced inside the drum, which causes vibration of the outer tank and noise caused by the vibration. For this problem, it is proposed that a balance in weight in the direction of rotation of the drum is attained by providing a plurality of water storage boxes, for example, capable of storing water by centrifugal force developed at the time of rotating the drum on the end surface of the drum, and making, when the eccentric load due to the uneven distribution of the washing is produced inside the drum, the amount of water in the water storage box at a position near to the position of the eccentric load smaller than the amount of water in the other water storage box to set off the eccentric load by the weight of the water.

In the drum washing machine according to the prior art, an opening for getting the washing in and out of the drum is formed in the front end surface of the drum. Accordingly, the water storage box cannot be provided on the front end surface of the drum, but is inevitably provided on the rear end surface of the drum. However, the eccentric load due to the uneven distribution of the washing is easily produced at a position, offset toward the opposite side (on this side) of the motor, in the drum. In this case, even if the amount of water in the water storage box provided on the rear end surface of the drum is adjusted, the eccentric load cannot, in some cases, be sufficiently compensated for.

Therefore, a primary object of the present invention is to solve the above-mentioned technical problems and to provide a drum washing machine capable of satisfactorily compensating for an eccentric load produced by the uneven distribution of the washing in a drum and restraining vibration and noise at the time of spin-drying.

Still another object of the present invention is to provide a drum washing machine that is convenient to use and produces a quiet operating sound.

SUMMARY OF THE INVENTION

In order to attain the above-mentioned object, the present invention is directed to a drum washing machine having a drum (4) for putting the washing, and rotating the drum around its approximately horizontal axis of rotation to spin-dry the washing put in the drum by centrifugal force, characterized by comprising rotating shafts (51L, 51R) respectively extending outward along the axis of rotation from both end surfaces (41L, 41R) of the drum; a drum rotating motor (6) coupled to one of the rotating shafts; and a water storage balancer (G) comprising a plurality of water storage tanks (8) attached to the end surface (41L), on the opposite side of the position where the drum rotating motor is provided, of the drum and formed on its circumference centered around the axis of rotation, the amount of water in each of the water storage tanks (8) being adjusted so as to set off an eccentric load produced in the drum by the uneven distribution of the washing.

An alphanumeric character put in parentheses denotes a corresponding constituent element or the like in an embodiment, described later. The same is true for the following summary items.

According to the present invention, the drum is supported so as to be rotatable by the rotating shafts respectively extending in an approximately horizontal direction outward from both the end surfaces. The drum rotating motor is coupled to one of the rotating shafts, and the water storage balancer for setting off the eccentric load produced in the drum by the uneven distribution of the washing is attached to the end surface, on the opposite side of the position where the drum rotating motor is provided, of the drum.

Consequently, the washing is unevenly distributed at a position, offset toward the opposite side of the position where the drum rotating motor is provided, in the drum, thereby making it possible to set off, even when the eccentric load is produced in the drum, the eccentric load by the function of the water storage balancer. Accordingly, it is possible to satisfactorily restrain the generation of vibration caused by the uneven distribution of the washing and noise caused by the vibration.

The drum washing machine according to the present invention may further comprise a motor-side water storage balancer (G) comprising a plurality of water storage tanks (8) attached to the end surface (41R), on the side of the position where the drum rotating motor is provided, of the drum and formed on its circumference centered around the axis of rotation, the amount of water in each of the water storage tanks being adjusted so as to set off an eccentric load produced in the drum by the uneven distribution of the washing.

When such construction is added, the washing is unevenly distributed at the position, offset toward the side of the position where the drum rotating motor is provided, in the drum, thereby making it possible to set off, even when the eccentric load is produced in the drum, the eccentric load by the function of the motor-side water storage balancer. Accordingly, it is possible to effectively restrain the generation of vibration caused by the uneven distribution of the washing and noise caused by the vibration.

The drum washing machine according to the present invention may further comprise a fluid balancer (9) attached to the end surface, on the opposite side of the position where the drum rotating motor is provided, of the drum, and setting off vibration caused by the uneven distribution of the washing due to the uneven distribution of a liquid inside the drum at the time of rotating the drum at high speed.

The present invention may further comprise a motor-side fluid balancer (9) attached to the end surface, on the side of the position where the drum rotating motor is provided, of the drum, and setting off vibration caused by the uneven distribution of the washing due to the uneven distribution of a liquid inside the drum at the time of rotating the drum at high speed.

When such construction is added, the fluid balancer is provided, thereby making it possible to restrain vibration which cannot be restrained depending on the function of the water storage balancer and vibration caused by an eccentric load which is so small that it need not be compensated for by making balance adjustment using the water storage balancer. Accordingly, it is possible to effectively restrain the vibration and noise caused by the vibration.

The washing machine according to the present invention may further comprise an outer tank (2) elastically supported by an elastic member (3F, 3B) and accommodating the drum so as to be rotatable. Further, the elastic member maybe a damper (3F, 3B) for supporting a portion, near the drum rotating motor, of the outer tank from below. In this case, the eccentric load due to the uneven distribution of the washing is almost produced on the opposite side of the drum rotating motor with respect to the position where the outer tank is supported by the damper. Accordingly, the present invention is particularly effective in restraining the vibration caused by the eccentric load and the noise caused by the vibration.

The foregoing and other objects, features, aspects and advantages of the present invention will become more apparent from the following detailed description of the present invention when taken in conjunction with the accompanying drawings.

DESCRIPTION OF PREFERRED EMBODIMENTS

An embodiment of the present invention will be described in detail with reference to the accompanying drawings.

Figure 1:
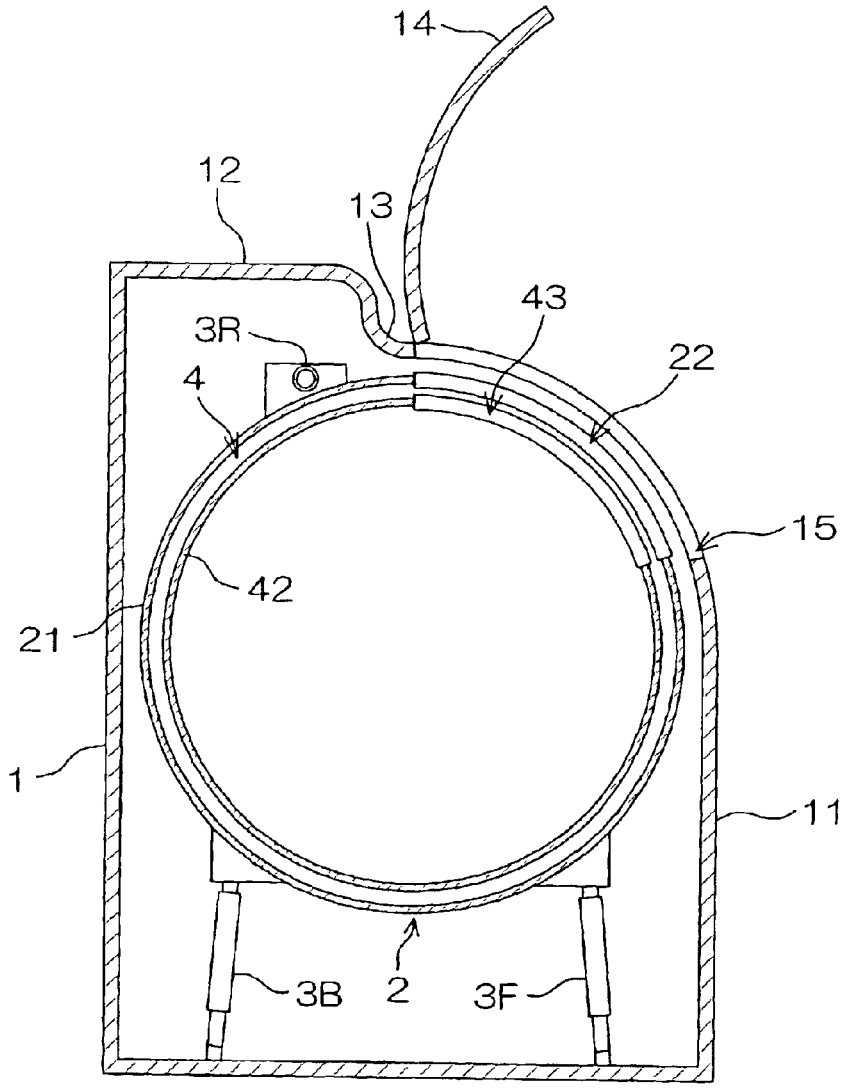
FIG. 1 is a cross-sectional view of a drum washing machine according to an embodiment of the present invention taken along a vertical surface in a front-and-back direction.
Figure 2:
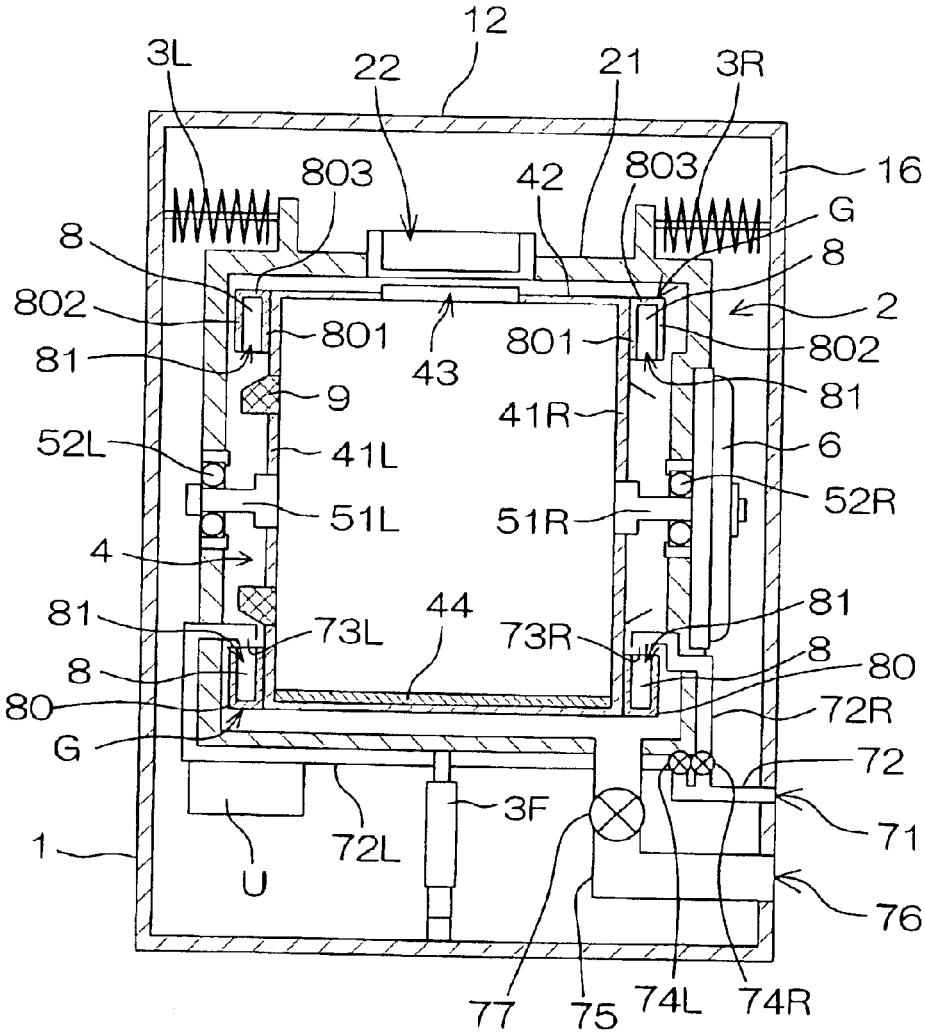
FIG. 2 is a cross-sectional view of the drum washing machine taken along a vertical surface in a right-and-left direction.

FIGS. 1 and 2 are longitudinal sectional views showing the overall construction of a drum washing machine according to an embodiment of the present invention, where FIG. 1 illustrates a cross section of the drum washing machine taken along a vertical surface in a front-and-back direction, and FIG. 2 illustrate a cross section of the drum washing machine taken along a vertical surface in a right-and-left direction.

A case 1 constituting the appearance of the drum washing machine is formed in such a size that the drum washing machine can be set up in a washing machine pan. Further, the drum washing machine is so designed that the height thereof in a case where it is set up on the floor (the height from the floor to an upper surface of the case 1)is approximately to the waste waist of a user.

An outer tank 2 in a hollow cylindrical shape is provided with its end surfaces extending in a right-and-left direction inside the case 1. The outer tank 2 is supported by a pair of dampers 3F and 3B and a pair of coiled springs 3L and 3R. Specifically, the pair of dampers 3F and 3B connects an inner bottom surface of the case 1 to the outer tank 2, to respectively support positions near the lower front and the lower rear of the outer tank 2. Further, the pair of coiled springs 3L and 3R respectively connects a left side surface and a right side surface of the case 1 to the outer tank 2, to support a position near the upper rear of the outer tank 2.

A drum 4 for putting the washing is provided with its end surfaces extending in a right-and-left direction inside the outer tank 2. Both the end surfaces of the drum 4 are respectively closed by end surface walls 41L and 41R, and rotating shafts 51L and 51R are respectively connected to the centers of the end surface walls 41L and 41R. The rotating shafts 51L and 51R respectively extend rightward and leftward from the end wall surfaces 41L and 41R along the same axis of rotation set in a direction approximately orthogonal to right and left side surfaces of the case 1, and are respectively received so as to be rotatable by bearings 52L and 52R attached to the outer tank 2. A motor 6 is coupled using a DD (Direct Drive) system to a right end of the rotating shaft 51R, and the drum 4 is rotated around the axis of rotation inside the outer tank 2 by driving force of the motor 6.

An opening 43 for getting the washing in and out of the drum is formed on a peripheral surface wall 42 of the drum 4. Further, a front surface 11 and an upper surface 12 of the case 1 are connected to each other by a projected curve 13, which is a circular arc in cross section, taken along a vertical surface in a front-and-back direction. An opening 15, which can be opened or closed by an opening/closing cover 14, is formed in the projected curve 13. An opening 22 is formed at a position, opposite to the opening 15 of the case 1, in a peripheral surface wall 21 of the outer tank 2. The stop position of the drum 4 is controlled such that the opening 43 is overlapped with the opening 22 of the outer tank 2. Consequently, the opening/closing cover 14 is opened in a state where the drum 4 is stopped, thereby making it possible to get the washing in and out of the drum 4 through the openings 15, 22, and 43 obliquely from above.

Each of the opening 22 of the outer tank 2 and the opening 43 of the drum 4 is provided with a slide-type or lifting-type opening/closing cover, which is not illustrated, to get the washing in and out of the drum 4 with the opening/closing cover opened. The opening/closing cover for the opening 43 of the drum 4 may be so constructed as to be automatically opened or closed, when the opening/closing cover for the opening 22 of the outer tank 2 is opened or closed, in synchronization therewith. Further, in order to correct an imbalance in weight caused by providing the opening/closing cover for the opening 43 of the drum 4, an opening balancer 44 is attached to a position, substantially opposite to the opening 43 with respect to the axis of rotation, on an inner surface of the peripheral surface wall 42 of the drum 4.

A hose connection port 71 for connecting a water supply hose leading to outer water works, for example, is provided on the right side surface 16 of the case 1, and a water supply tube 72 extends toward the inside of the case 1 from the hose connection port 71. The water supply tube 72 branches halfway into branch tubes 72L and 72R. Respective ends of the branch tubes 72L and 72R enter the outer tank 2, to respectively form water pouring ports 73L and 73R below the rotating shafts 51L and 51R. Further, water supply valves 74L and 74R for allowing and preventing the circulation of water to the water pouring ports 73L and 73R are respectively provided halfway in the branch tubes 72L and 72R. When the water supply valves 74L and 74R are respectively opened, water supplied through the water supply hose leads to the water pouring ports 73L and 73R through the water supply tube 72, and is drained off downward from the water pouring ports 73L and 73R.

Furthermore, one end of a drainage tube 75 is connected to the lowermost part of the peripheral surface wall 21 of the outer tank 2, and the other end of the drainage tube 75 is connected to a drainage port 76 provided on the right side surface 16 of the case 1. A drainage valve 77 is provided halfway in the drainage tube 75. The water supply valves 74L and 74R are opened with the drainage valve 77 closed, to supply water from the water pouring ports 73L and 73R, thereby making it possible to store in the outer tank 2 the water drained from the water pouring ports 73L and 73R. Further, the water stored in the outer tank 2 can be drained outward through the drainage tube 75 and the drainage port 76 by opening the drainage valve 77.

A lot of water through holes (not shown) are pierced in the peripheral surface wall 42 of the drum 4, and the water stored in the outer tank 2 flows into the drum 4 through the water through holes. Further, a baffle (not shown) for lifting the washing is provided at a suitable position on the inner surface of the peripheral surface wall 42 of the drum 4. At the time of washing and rinsing, the drum 4 is rotated with the water stored in the outer tank 2, so that the washing inside the drum 4 is lifted by the baffle to naturally drop down toward the surface of the water from a certain degree of height, which operation is repeated. At the time of spin-drying, the drum 4 is rotated at high speed, so that water is wrung out of the washing in the drum 4 by centrifugal force, and the water wrung out of the washing is sprinkled toward the outer tank 2 through the water through holes.

When the washing is unevenly distributed inside the drum 4 at the time of the spin-drying, an eccentric load is produced due to the uneven distribution, which may cause vibration and noise caused by the vibration. In the present embodiment, therefore, water storage balancers G each having a plurality of water storage tanks 8 on its outer surface are respectively provided on both the end surface walls 41L and 41R of the drum 4. Further, an annular fluid balancer 9 is attached to a region inside (on the side of the rotation center of) a region where the water storage tank 8 is provided.

The drum washing machine also has the function of drying the washing which has been spin-dried. A unit U for the drying function is attached to a position near the lower left of the outer tank 2, as shown in FIG. 2. Since the unit U for the drying function has a relatively large weight, the unit U is attached to a position, on the opposite side of the motor 6 with respect to the center of the outer tank 2, in the drum 4, thereby attaining a balance in weight added to the outer tank 2.

Figure 3:
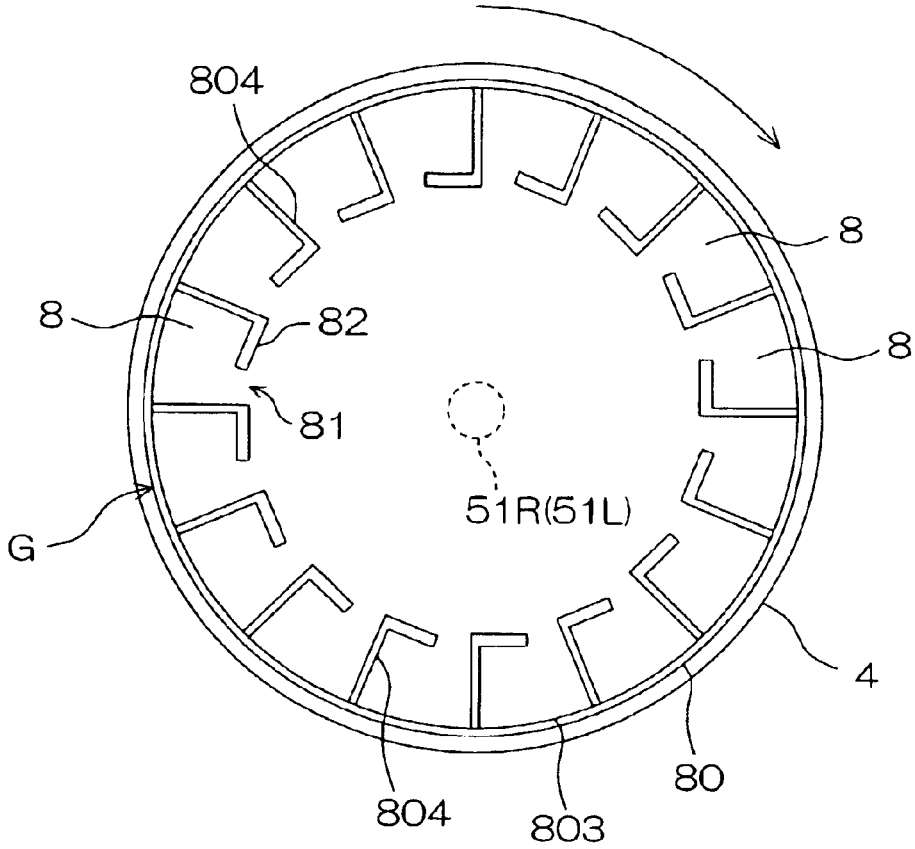
FIG. 3 is a cross-sectional view for explaining the construction of a water storage balancer.

FIG. 3 is a cross-sectional view for explaining the construction of the water storage balancer G, which illustrates a cross section of the water storage balancer G, attached to the end surface wall 41R of the drum 4, taken along a surface orthogonal to the axis of rotation of the drum 4 as viewed from the right of the drum 4. The water storage balancers G attached to the end surface walls 41L and 41R of the drum 4 are respectively formed in an annular shape surrounding the rotating shafts 51L and 51R.

Referring to FIGS. 2 and 3, the water storage balancer G has a container 80 comprising a pair of annular plates 801 and 802 arranged parallel to each other with predetermined spacing along the axis of rotation of the drum 4 and a peripheral surface plate 803 closing outer peripheral surfaces of the pair of annular plates 801 and 802. A plurality of section plates 804 are provided in the radial direction at equal angular intervals centered around the axis of rotation of the drum 4 inside the container 80, and a portion between the adjacent section plates 804 forms a water storage tank 8. In the present embodiment, sixteen section plates 804 are provided inside the container 80, whereby sixteen water storage tanks 8 are defined inside the container 80.

Each of the water storage tanks 8 has an opening 81 opened toward the center of rotation (the rotating shafts 51L and 51R) A partition plate 82 is provided for the opening 81 of each of the water storage tanks 8 so as to cover approximately one-half to two-thirds of the opening 81 from the far side in the direction of rotation of the drum 4. By this construction, each of the water storage tanks 8 can receive water supplied from the water pouring port 73L or 73R (see FIG. 2) when it is positioned in the lowermost part of the drum 4 by the rotation of the drum 4, and can prevent water from spilling from the undesirable water storage tank 8 at the time of balance adjustment, described later.

Figure 4A:
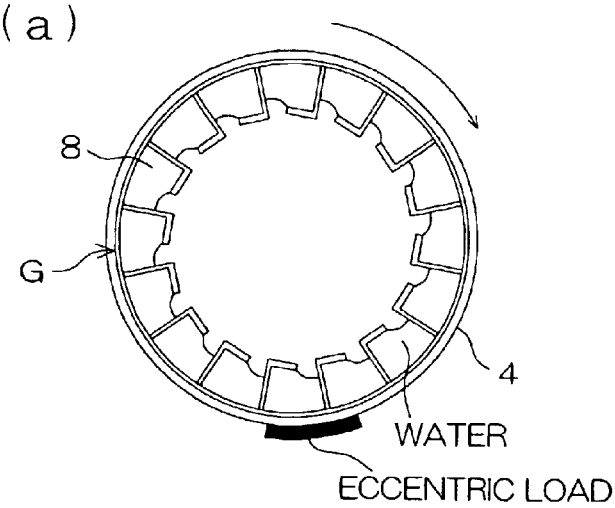
FIGS. 4(*a*) to 4(*c*) are diagrammatic cross-sectional views for explaining balance adjustment made at the time of spin-drying.
Figure 4B:
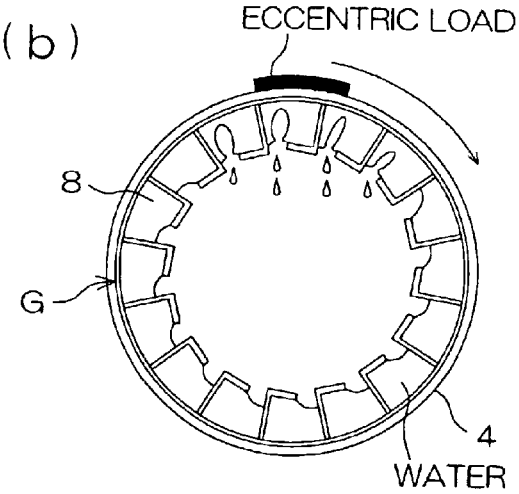
Figure 4C:
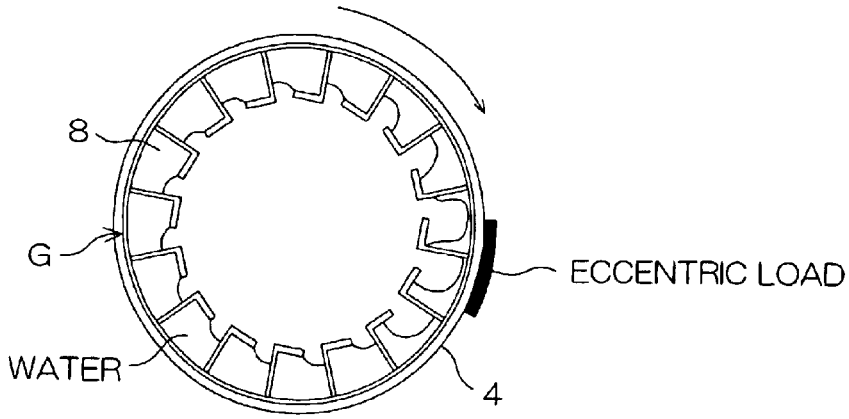

FIG. 4 are diagrammatic cross-sectional views for explaining balance adjustment made at the time of spin-drying. Referring to FIG. 4 and FIG. 2, described above, balance adjustment made at the time of spin-drying will be described.

When the rotational speed of the drum 4 is gradually raised at the time of spin-drying (for example, the rotational speed of the drum 4 is 0, 100, 300, 500, 700, and 1000 rpm in this order), processing for balance adjustment is performed in each step. In this processing, in a state where the drum 4 is being rotated at a predetermined speed (a rotational speed in each step), the magnitude and the position (the angular position) of an eccentric load produced in the drum 4 at that time are first detected. The magnitude and the position of the eccentric load can be detected on the basis of an output of an acceleration sensor (not shown), for example, for detecting acceleration in the vertical direction of the outer tank 2.

Specifically, the minimum peak of an acceleration component detected by the acceleration sensor appears in making an attempt to lift the washing which causes the eccentric load upward against gravity in a time period during which the drum 4 is rotated once. Consequently, the minimum peak generally appears when the eccentric load exists within an angular range of approximately 90 on this side in the direction of rotation of the highest position in the drum 4. The position of the eccentric load in the drum 4 can be detected utilizing the characteristics. Further, the amplitude of variation in the acceleration component, that is, the difference between the maximum peak value and the minimum peak value corresponds to the magnitude of the eccentric load produced in the drum 4. If the relationship between the magnitude of the eccentric load produced in the drum 4 and the amplitude of variation in the acceleration component is previously examined, therefore, the magnitude of the eccentric load can be found from the amplitude of variation in the acceleration component detected by the acceleration sensor on the basis of the relationship.

It is then judged whether or not the magnitude of the eccentric load detected in the above-mentioned manner is not more than a predetermined reference value depending on the rotational speed of the drum 4. When the magnitude of the eccentric load is larger than the reference value, balance adjustment for compensating for the eccentric load is made by adjusting the amount of water inside each of the water storage tanks 8 in the water storage balancer G.

In the balance adjustment, the water supply valves 74L and 74R are opened in a state where the drum 4 is being rotated at a predetermined water pouring speed (e.g., 100 rpm) to drain water from the water pouring ports 73L and 73R. The water storage balancers G that rotate integrally with the drum 4 respectively exist below the water pouring ports 73L and 73R. Accordingly, the water drained form the water pouring ports 73L and 73R is stored, respectively, in the water storage tanks 8 opposite to the water pouring ports 73L and 73R. The water pouring speed is set to a rotational speed higher than a rotational speed at which centrifugal force exerted on the water stored in the water storage tank 8 and gravity are in balance. The water stored in the water storage tank 8 is held in the water storage tank 8 without spilling from the opening 81 by the centrifugal force. Further, centrifugal force exerted on the washing is also greater than the weight of the washing. Accordingly, the washing does not move or drop inside the drum 4.

When this state is continued for a predetermined time period, all the water storage tanks 8 become almost full of water W, as shown in FIG. 4(*a*). While water is poured into the water storage tanks 8, the washing adheres to an inner peripheral surface of the drum 4 by centrifugal force. Accordingly, the state of the eccentric load due to the uneven distribution of the washing is not changed. Therefore, the eccentric load produced in the drum 4 is not changed before and after the water is stored in the water storage tanks 8.

The drum 4 which has been rotated at the above-mentioned water pouring speed is then rapidly decelerated to approximately 45 rpm for only a short time at timing corresponding to the angular position of the eccentric load. Consequently, centrifugal force exerted on the water in the water storage tank 8 is smaller than gravity, so that the water spills from the water storage tank 8 positioned above in the direction of rotation, as shown in FIG. 4 (*b*). Contrary to this, the water in the water storage tank 8 provided below in the direction of rotation and the water in the water storage tank 8 which will be directed downward in the direction of rotation are held without spilling from the water storage tank 8.

Thereafter, the magnitude and the position of the eccentric load produced in the drum 4 are detected again. It is judged whether or not the magnitude of the eccentric load is not more than the above-mentioned reference value. When the magnitude of the eccentric load exceeds the reference value, such control as to rapidly reduce the rotational speed of the drum 4 temporarily from the water pouring speed to 45 rpm is repeatedly carried out until the magnitude of the eccentric load is not more than the reference value. When the magnitude of the eccentric load produced in the drum 4 becomes not more than the reference value, processing for the balance adjustment is terminated. At this time, the water is reduced only by an amount corresponding to the magnitude of the eccentric load from the water storage tank 8 in the vicinity of the position of the eccentric load, so that the eccentric load produced in the drum 4 is reduced, as shown in FIG. 4(*c*).

Figure 5:
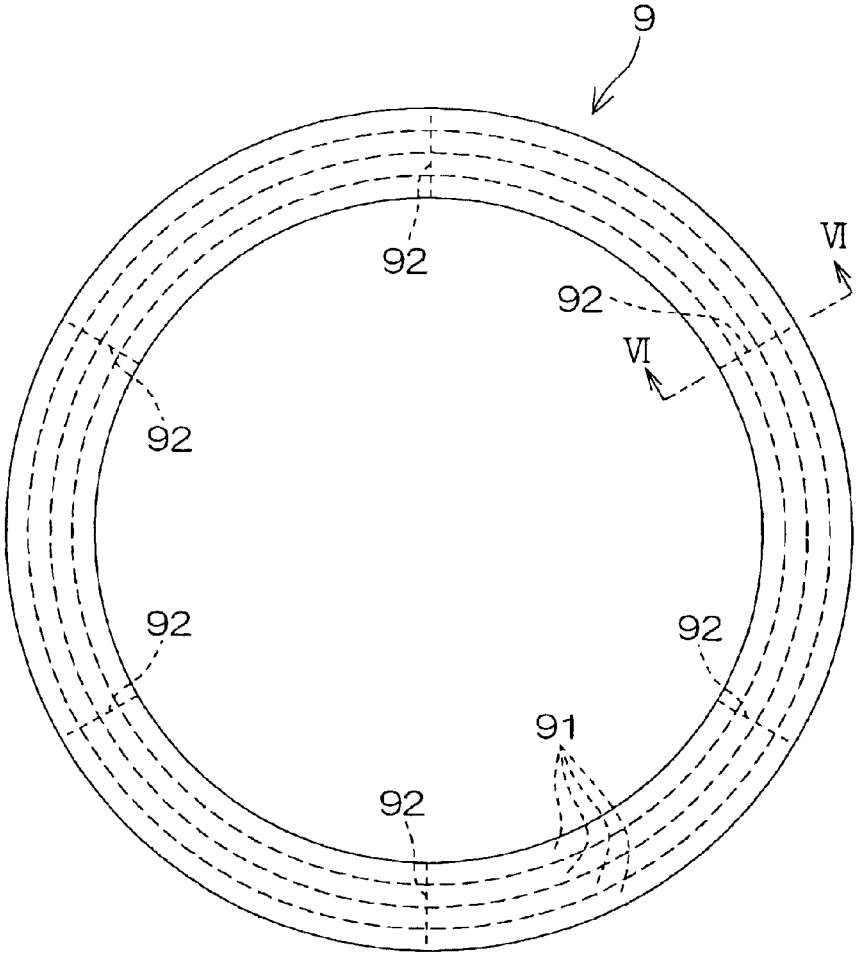
FIG. 5 is a diagram showing a fluid balancer as viewed from the side of a drum.
Figure 6:
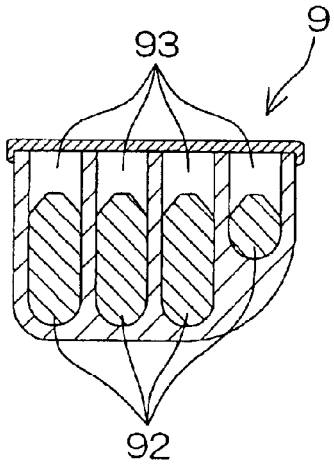
FIG. 6 is a cross-sectional view taken along a line VI—VI shown in FIG. 5.

FIG. 5 is a diagram showing the fluid balancer 9 as viewed from the side of the drum 4. FIG. 6 is a cross-sectional view taken along a line VI—VI shown in FIG. 5. Inside the fluid balancer 9, four fluid paths 91 along its circumference are formed. A predetermined amount of liquid (e.g., salt water) is sealed in each of the fluid paths 91.

Furthermore, a partition plate 92 is provided for each predetermined angle (e.g., approximately 60°) in each of the fluid paths 91. The liquid in each of the paths 91 can be freely circulated through a clearance 93 between the partition plate 92 and an inner surface of the fluid balancer 9. Consequently, the liquid in the fluid balancer 9 is unevenly distributed so as to make the drum 4 vibrate in the same phase as the vibration caused by the uneven distribution of the washing while the drum 4 is rotated at low speed (approximately 100 rpm). When the rotational speed of the drum 4 exceeds a certain speed (approximately 300 rpm), the washing is unevenly distributed so as to make the drum 4 vibrate in the opposite phase to the vibration caused by the uneven distribution of the washing. When the drum 4 is rotated at high speed, therefore, the vibration caused by the uneven distribution of the washing can be set off by the vibration caused by the uneven distribution of the liquid in the fluid balancer 9, thereby making it possible to restrain the vibration of the drum 4.

As described in the foregoing, according to the present embodiment, the drum 4 is supported so as to be rotatable by the rotating shafts 51L and 51R respectively extending in an approximately horizontal direction outward from the end surface walls 41L and 41R. The water storage balancers G are respectively attached to the end surface walls 41L and 41R of the drum 4, and the fluid balancer 9 is further attached to the end surface wall 41L. When the eccentric load due to the uneven distribution of the washing is produced at a position, offset toward the end surface wall 41L, in the drum 4 at the time of the spin-drying, therefore, the eccentric load can be set off by the function of the water storage balancer G attached to the end surface wall 41L. When the eccentric load due to the uneven distribution of the washing is produced at a position, offset toward the end surface wall 41R, in the drum 4, the eccentric load can be set off by the function of the water storage balancer G attached to the end surface wall 41R. Further, the fluid balancer 9 is provided, thereby making it possible to also restrain vibration caused by an eccentric load which is so small that it need not be compensated for by making balance adjustment using the water storage balancers G. Accordingly, the vibration and noise caused by the vibration are hardly generated.

Although description was made of an embodiment of the present invention, the present invention can be also embodied in other embodiments. Although in the above-mentioned embodiment, such construction that the water storage balancers G are respectively attached to both the end surface walls 41L and 41R of the drum 4, and the fluid balancer 9 is attached to the end surface wall 41L on the opposite side of the position where the motor 6 is provided is taken as an example, the respective numbers of water storage balancers G and fluid balancers 9 and the respective arrangements thereof may be freely changed using construction shown in FIG. 7 as a base.

Figure 7:
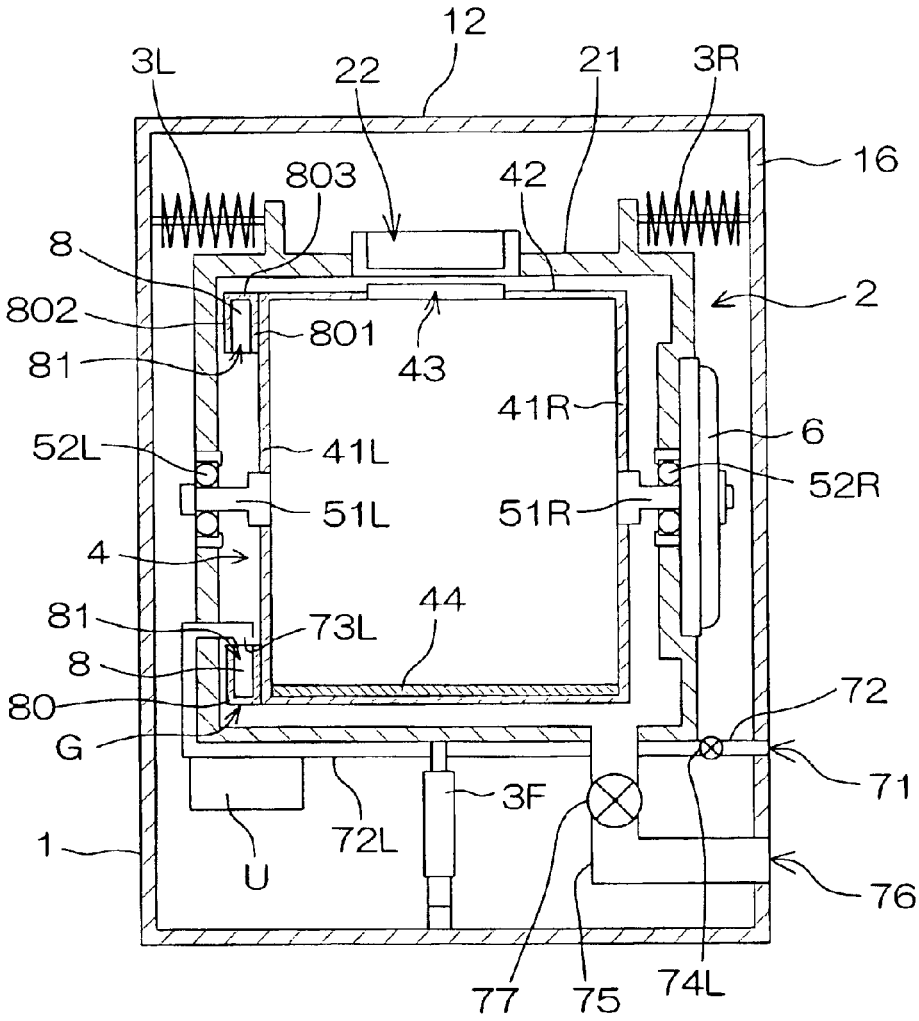
FIG. 7 is a cross-sectional view for explaining a second embodiment of the present invention.

Specifically, as shown in FIG. 7, one water storage balancer G may be provided on only an end surface wall 41L, on the opposite side of a motor 6, of a drum 4 (on the left side in FIG. 7), and the water storage balancer G provided on the end surface wall 41R, the branch tube 72R, the water pouring port 73R, and the water supply valve 74R for pouring water to the water storage balancer G, and the fluid balancer 9 in the above-mentioned embodiment may be omitted. In such construction that the motor 6 is coupled using a DD system to one of rotating shafts 51L and 51R in the drum 4, an eccentric load due to the uneven distribution of the washing is produced on the opposite side of the motor 6 with respect to the position where an outer tank 2 is supported by dampers 3F and 3B in almost all cases. Even if the water storage balancer G is provided on only the end surface wall 41L, on the opposite side of the motor 6, of the drum 4 (on the left side in FIG. 7), therefore, it is possible to effectively restrain vibration caused by the uneven distribution of the washing and noise caused by the vibration.

Figure 8:
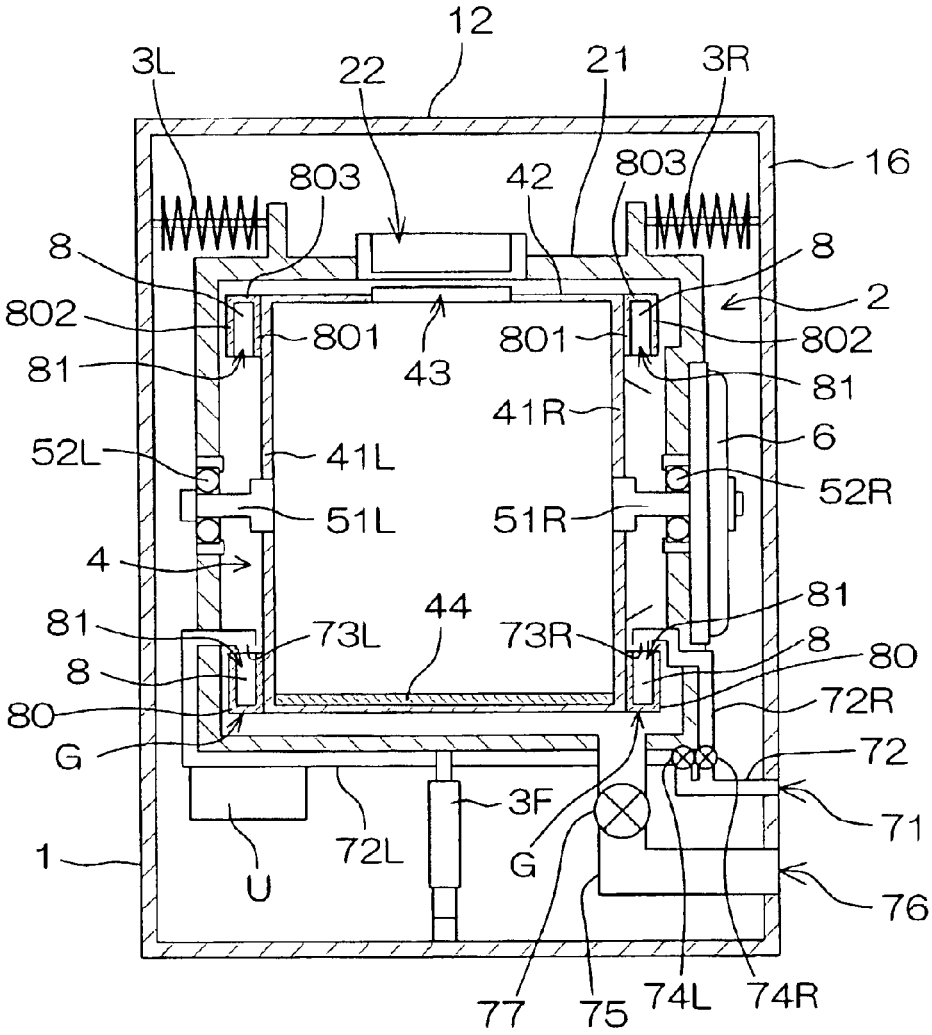
FIG. 8 is a cross-sectional view for explaining a third embodiment of the present invention.

Such construction that water storage balancers G are respectively provided on both end surface walls 41L and 41R of a drum 4, and the fluid balancer 9 provided on the end surface wall 41L in the above-mentioned construction shown in FIG. 2 is omitted, as shown in FIG. 8, may be employed.

Figure 9:
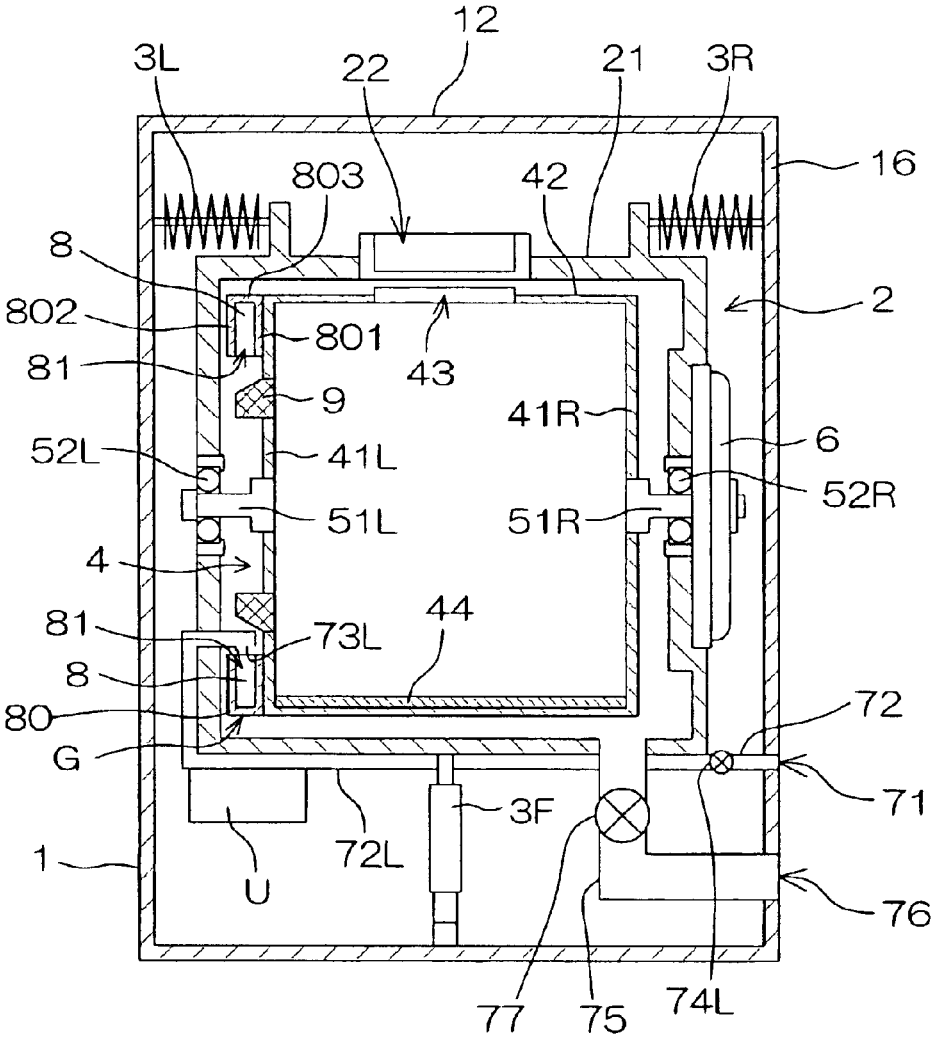
FIG. 9 is a cross-sectional view for explaining a fourth embodiment of the present invention.

Furthermore, such construction that a water storage balancer G and a fluid balancer 9 are provided on an end surface wall 41L, on the opposite side of a motor 6, of a drum 4 (on the left side in FIG. 9), and the water storage balancer G provided on the end surface wall 41R, and the branch tube 72R, the water pouring port 73R, and the water supply valve 74R for pouring water to the water storage balancer G in the above-mentioned construction shown in FIG. 2 are omitted, as shown in FIG. 9, may be employed.

Furthermore, the fluid balancer 9 may be further provided on an end surface wall 41R of the drum 4 in addition to the above-mentioned construction shown in FIG. 2.

In addition thereto, various types of design changes may be made in a range of items described in the claims.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A drum washing machine having a drum for receiving the washing, the drum having an approximately horizontal axis of rotation, and opposing first and second end surfaces, the drum washing machine rotating the drum around the horizontal axis of rotation to spin-dry the washing disposed in the drum by centrifugal force, comprising:

a first rotating shaft extending outward along the axis of rotation from the first end surface of said drum;

a second rotating shaft extending outward along the axis of rotation from the second end surface of said drum;

a drum rotating motor coupled to the first rotating shafts;

a water storage balancer comprising a plurality of water storage tanks attached to the second end surface, on a side of said drum that is opposite of a side where said drum rotating motor is provided, said water storage tanks being formed on a circumference of said drum and being centered around the axis of rotation, an amount of water stored in each of the water storage tanks being adjusted so as to off set an eccentric load produced in said drum by an uneven distribution of the washing; and controller means for reducing the amount of water stored in selected ones of said water storage tanks located in a vicinity of a position of the eccentric load to correspond to a magnitude of the eccentric load, by rotating the drum rotating motor at a high rotational speed that is higher than a rotational speed at which centrifugal force exerted on the water stored in the water storage tank and gravity are in balance, and with the drum rotating motor being rotated at the high rotational speed, adding water to the water storage tanks so as to become almost full of water, and then rapidly decelerating the rotational speed for only a short time and at a timing corresponding to an angular position of the eccentric load so that the water stored in the selected ones of said water storage tanks spills therefrom to compensate for the eccentric load.

2. The drum washing machine according to claim 1, further comprising a motor-side water storage balancer comprising a plurality of water storage tanks attached to the first end surface, on the side of the drum where said drum rotating motor is provided, and being formed on the circumference and centered around the axis of rotation, the amount of water in each of the water storage tanks being adjusted so as to off set an eccentric load produced in said drum by the uneven distribution of the washing.

3. The drum washing machine according to claim 2, further comprising a fluid balancer attached to the second end surface, and off setting vibration caused by the uneven distribution of the washing due to the uneven distribution of a liquid inside the drum at the time of rotating the drum at high speed.

4. The drum washing machine according to claim 3, further comprising an outer tank elastically supported by an elastic member and accommodating said drum so as to be rotatable.

5. The drum washing machine according to claim 2, further comprising an outer tank elastically supported by an elastic member and accommodating said drum so as to be rotatable.

6. The drum washing machine according to claim 2, wherein an opening, which can be opened or closed, for accessing the washing in said drum, is formed on a peripheral surface wall of the drum.

7. The drum washing machine according to claim 1, further comprising a fluid balancer attached to the second end surface, and off setting vibration caused by the uneven distribution of the washing due to the uneven distribution of a liquid inside the drum at the time of rotating the drum at high speed.

8. The drum washing machine according to claim 7, further comprising an outer tank elastically supported by an elastic member and accommodating said drum so as to be rotatable.

9. The drum washing machine according to claim 7, wherein an opening, which can be opened or closed, for accessing the washing in said drum, is formed on a peripheral surface wall of the drum.

10. The drum washing machine according to claim 1, further comprising a motor-side fluid balancer attached to the first end surface, on the side of the drum where said drum rotating motor is provided, and off setting vibration caused by the uneven distribution of the washing due to the uneven distribution of a liquid inside the drum at the time of rotating the drum at high speed.

11. The drum washing machine according to claim 10, further comprising an outer tank elastically supported by an elastic member and accommodating said drum so as to be rotatable.

12. The drum washing machine according to claim 1, further comprising an outer tank elastically supported by an elastic member and accommodating said drum so as to be rotatable.

13. The drum washing machine according to claim 1, wherein an opening, which can be opened or closed, for accessing the washing in said drum, is formed on a peripheral surface wall of the drum.

14. The drum washing machine according to claim 13, further comprising an outer tank having an opening, which can be opened or closed, formed on a peripheral surface wall thereof, said drum being controlled to stop such that the opening thereof is overlapped with the opening of the outer tank.

15. The drum washing machine according to claim 13, further comprising an opening balancer attached to an inner peripheral surface wall of the drum and at a position substantially opposite to the opening with respect to the axis of rotation.

16. The drum washing machine according to claim 1, wherein the drum rotating motor includes a DD (Direct Drive motor).

17. The drum washing machine according to claim 1, further comprising a drying function unit attached to the side of the drum opposite to the drum rotating motor.

* * * * *